US010196990B2

(12) United States Patent
Dettinger et al.

(10) Patent No.: US 10,196,990 B2
(45) Date of Patent: Feb. 5, 2019

(54) INTAKE MODULE OF A FRESH AIR SYSTEM

(71) Applicant: Mahle International GmbH, Stuttgart (DE)

(72) Inventors: Marco Dettinger, Pforzheim (DE); Mathias Endress, Stuttgart (DE); Wolfgang Gueth, Stuttgart (DE)

(73) Assignee: Mahle International GmbH (DE)

( * ) Notice: Subject to any disclaimer, the term of this patent is extended or adjusted under 35 U.S.C. 154(b) by 16 days.

(21) Appl. No.: 15/557,730

(22) PCT Filed: Mar. 7, 2016

(86) PCT No.: PCT/EP2016/054780
§ 371 (c)(1),
(2) Date: Sep. 12, 2017

(87) PCT Pub. No.: WO2016/146416
PCT Pub. Date: Sep. 22, 2016

(65) Prior Publication Data

US 2018/0066592 A1 Mar. 8, 2018

(30) Foreign Application Priority Data

Mar. 13, 2015 (DE) ..... 10 2015 204 604

(51) Int. Cl.
*F02D 9/10* (2006.01)
*F02M 35/10* (2006.01)

(52) U.S. Cl.
CPC ..... *F02D 9/1095* (2013.01); *F02D 9/106* (2013.01); *F02D 9/107* (2013.01); *F02D 9/1065* (2013.01);
(Continued)

(58) Field of Classification Search
CPC ..... F02D 9/106; F02D 9/1065; F02D 9/107; F02D 9/1095; F02M 35/10078; F02M 35/10255
(Continued)

(56) References Cited

U.S. PATENT DOCUMENTS 4,907,547 A * 3/1990 Daly ..... F02B 27/0263 123/184.53
5,813,380 A * 9/1998 Takahashi ..... F02B 27/02 123/184.55
(Continued)

FOREIGN PATENT DOCUMENTS

DE 69012150 T2 2/1995
DE 4499626 T1 * 2/1996 ..... F02B 27/02
(Continued)

OTHER PUBLICATIONS

English abstract for DE-102011087234.
(Continued)

*Primary Examiner* — John Zaleskas
(74) *Attorney, Agent, or Firm* — Fishman Stewart PLLC

(57) ABSTRACT

An intake module of a fresh air system for an internal combustion engine may include a housing having a plurality of openings through which fresh air is flowable, and a control device for controlling a cross-section of at least one of the openings. The control device may include at least one control staff and at least one control valve arranged on the control shaft in a rotationally fixed manner for the at least one opening. The control shaft may be mounted on the housing by at least one bearing bracket such that the control shaft is rotatable about a rotational axis. The housing may have at least one bearing receiving portion for receiving the bearing bracket. The bearing receiving portion may have an insertion opening through which the bearing bracket may be inserted in an insertion direction oriented perpendicular to
(Continued)

the rotational axis. The bearing bracket may have two outer surfaces facing away from one another in a transverse direction running perpendicular to the rotational axis and to the insertion direction. On each outer surface, the bearing bracket may have at least two positioning blocks projecting therefrom and spaced apart from one another in the insertion direction. The bearing receiving portion may have a guide contour for each positioning block for aligning the bearing bracket in a longitudinal direction running parallel to the rotational axis, and in the transverse direction.

20 Claims, 4 Drawing Sheets

(52) U.S. Cl.
CPC ..... *F02M 35/10078* (2013.01); *F02M 35/10255* (2013.01)

(58) Field of Classification Search
USPC ..... 123/336, 337
See application file for complete search history.

(56) References Cited

U.S. PATENT DOCUMENTS 6,763,802 B1 * 7/2004 Brassell ..... F02B 23/08 123/184.61
6,948,468 B1 * 9/2005 Decuir, Jr. ..... F01L 1/042 123/90.16
6,979,130 B1 * 12/2005 Stangier ..... F02B 27/02 123/184.53
7,162,997 B2 * 1/2007 Madeira ..... F02B 31/085 123/336
7,493,888 B2 * 2/2009 Ikegawa ..... F02D 9/107 123/336
7,604,763 B2 * 10/2009 Torii ..... B29C 45/14 123/337
8,028,677 B2 * 10/2011 Goldin ..... F02M 35/10144 123/184.21
8,555,847 B2 * 10/2013 Menin ..... F02B 31/06 123/184.21
2004/0261745 A1 * 12/2004 Kito ..... F02D 9/1095 123/184.42
2005/0016487 A1 * 1/2005 Ikuma ..... F02B 27/0263 123/184.42
2007/0144483 A1 * 6/2007 Torii ..... F02D 9/103 123/337
2008/0271697 A1 * 11/2008 Vichinsky ..... F02D 9/107 123/184.56
2015/0041013 A1 * 2/2015 Oiwa ..... F16K 1/224 137/862
2015/0068483 A1 * 3/2015 Buck ..... F02M 35/10255 123/184.53
2015/0211393 A1 * 7/2015 Ishihara ..... F02B 31/06 123/188.2

FOREIGN PATENT DOCUMENTS

DE 4499626 T1 2/1996
DE 102011087234 A1 * 5/2013 ..... F02M 35/10255
DE 102011087234 A1 5/2013
FR 2804740 A1 * 8/2001 ..... F02D 9/14
JP 07158458 A * 6/1995 ..... F02D 9/1095
JP H07-158458 A 6/1995
JP 2010-168995 A 8/2010
JP 2010168995 A * 8/2010
JP 2011220143 A * 11/2011 ..... F02B 31/06
JP 2014001719 A * 1/2014
JP 2014-101800 A 6/2014
JP 2014101800 A * 6/2014
JP 2014-1719 A 1/2017

OTHER PUBLICATIONS

English abstract for JP-2014-101800.
English abstract for JP-H07-158458.
English abstract for JP-2010-168995.
English abstract for JP-2014-1719.

* cited by examiner

INTAKE MODULE OF A FRESH AIR SYSTEM

CROSS-REFERENCE TO RELATED APPLICATIONS

This application claims priority to International Patent Application No. PCT/EP2016/054780, filed on Mar. 7, 2016, and German Patent Application No. DE 10 2015 204 604.4, filed on Mar. 13, 2015, the contents of both of which are incorporated herein by reference in their entireties.

TECHNICAL FIELD

The invention at hand relates to an intake module of a fresh air system for an internal combustion engine, in particular in a motor vehicle.

BACKGROUND

Such an intake module typically has a housing, which is equipped with an inlet opening for fresh air and with a flange section for fastening or connecting, respectively, the housing to the internal combustion engine. Provision is made in the flange section for a plurality of outlet openings for the fresh air. A distribution chamber, from which the fresh air supplied to the internal combustion engine via the inlet opening during operation, is distributed to the outlet openings, is typically embodied in the housing. Provision is thereby made for at least one such outlet opening for each combustion chamber. Such an intake module can be used in the case of a charged internal combustion engine as well as in the case of a non-charged internal combustion engine.

It is further common to equip such intake modules with a control device for controlling a cross section of at least one of the outlet openings, through which flow can pass. Typically, at least one such controllable outlet opening is thereby assigned to each combustion chamber. Provision can further be made for each combustion chamber of the internal combustion engine to be assigned two outlet openings, the one of which is in each case controlled, which can thus be changed with respect to its cross section, through which flow can pass, while the respective other outlet opening is not controlled, is thus permanently completely open. The fresh air supply can be optimized with the help of such a control device as a function of the current operating state of the internal combustion engine. Such a control device can be equipped with a control shaft, which has at least one control valve arranged in a rotationally-fixed manner on the control shaft for the respective outlet opening. The respective outlet opening can thus be controlled with respect to its cross section, through which flow can pass, with the help of the respective control valve. The respective outlet opening can in particular be opened or closed with the help of the corresponding control valve. On principle, any intermediate positions are likewise possible. Depending on the function of the control valve, the latter can also be identified as tumble valve or throttle valve.

Due to the fact that such an intake module is to be produced in large quantities and as cost-efficiently as possible, additional problems result when mounting the control shaft on the housing. The housing, which is typically injection molded of plastic, can warp as a result of the production process, which may impair a mounting of the control shaft with as little friction as possible. However, this creates the risk of an impairment of the functional reliability of the control shaft. The effort for realizing a functionally reliable mounting of the control shaft on the housing is thus comparatively high. Additional problems may result, e.g. in response to the subsequent installation of the control shaft into the housing, when the installation is to take place for example on a connection side of the flange section, which is provided for connecting the housing to the internal combustion engine. Warping of the housing results in relatively large production tolerances, which make a functionally reliable assembly of the control shaft more difficult.

Such problems do not only appear in the case of intake modules comprising controllable outlet openings, but in the case of all intake modules, in or on the housing of which controllable openings are provided. The invention at hand is thus not limited to intake modules comprising controllable outlet openings, but relates to all intake modules, which have or include controllable openings. This thus also relates to intake modules, which have bypass openings in their interior, which can be opened and closed for switching intake pipe lengths. Such a control device for controlling the cross sections of these bypass openings, through which flow can pass, can also be used for this purpose.

An intake module, which is equipped with a housing, which has an inlet opening for fresh air and a flange section comprising a plurality of outlet openings for fresh air is known from DE 44 99 626 T1. The known intake module has switchable intake pipe lengths, the effective length of which is switched by opening and closing bypass openings. For this purpose, the intake module is furthermore equipped with a control device for controlling a cross section of these bypass openings, through which flow can pass. The control device has a control shaft and a plurality of control valves, which are arranged in a rotationally-fixed manner on the control shaft, for the bypass openings. The control shaft is thereby mounted on the housing by means of at least one bearing bracket such that it can rotate about a rotational axis. The housing has at least one bearing receiving portion for receiving the respective bearing bracket, which has an insertion opening. The respective bearing bracket is thereby inserted in an insertion direction, which is oriented perpendicular to the rotational axis through the respective insertion opening into the respective bearing receiving portion. On its outside, the respective bearing bracket has two outer surfaces, which face away from one another with respect to a transverse direction, which runs perpendicular to the rotational axis and perpendicular to the insertion direction.

In the case of the known intake module, the outer surfaces of the respective bearing bracket in each case have a longitudinal groove, which runs parallel to the insertion direction. Provision is furthermore made on a front end of the bearing bracket, which leads in the insertion direction, for a projecting curved web, which extends in the circumferential direction. Complementary to the longitudinal grooves and to the curved web, provision is made on corresponding boundary walls of the corresponding bearing bracket for two straight webs, which project inwards, and for a curved groove, which extends in the circumferential direction. When the bearing bracket is inserted into the bearing receiving portion, the straight webs engage with the longitudinal grooves on the one hand and the curved web engages with the curved groove on the other hand, in each case in the manner of a nut-groove guide, in order to attain a positioning of the bearing bracket in the bearing receiving portion parallel to the rotational axis of the shaft. The positioning of the bearing bracket at right angles to the rotational axis takes place via the flat contact between the outer surfaces of the bearing bracket and corresponding inner surfaces of the bearing receiving portion, which need to be produced accurately for this purpose.

A generic intake module comprising the features of the preamble of claim 1 is known from JP 2014-101800 A. On each of the two outer surfaces, two positioning blocks, which are spaced apart from one another, are embodied therein. All positioning blocks are further arranged at and end of the bearing bracket, which is spaced apart from the control shaft.

A further intake module of this type is known from JP H07-158458 A, in the case of which only one positioning block is in each case provided on each of the two outer surfaces. The bearing bracket is further divided, so that it has two bearing parts, which are mounted against one another via an integral hinge such that they can move.

Further intake modules comprising bearing brackets are known from JP 2010-168995 A, from JP 2014-1719 A and from DE 10 2011 087 234 A1.

SUMMARY

The invention at hand deals with the problem of specifying an improved embodiment for an intake module of the above-mentioned type, which is in particular characterized by a reduced production effort. An improved mounting of the control shaft and/or an increased functional reliability of the control device are further desired.

The invention at hand relates to two basic aspects, which are independent from one another, which can thus be used alternatively, but which can preferably also be combined with one another. In particular, the one aspect including the embodiments thereof can be combined in any manner with the other aspect and the embodiments thereof.

The problem, on which the invention is based, is solved by said aspects, the subject matter of the independent claim. Advantageous embodiments follow from the dependent claims.

The invention at hand is based on the general idea of providing at least one control bracket, which represents a separate component with respect to the housing and with respect to the control shaft, and in that the control shaft is mounted such that it can rotate about a rotational axis, which runs concentrically to the control shaft, for mounting the control shaft.

The housing has a bearing receiving portion for the respective bearing bracket for receiving the bearing bracket. The bearing receiving portion is thereby open on the connection side of the flange section, so that the bearing bracket can be inserted into the respective bearing receiving portion through an insertion opening provided on the connection side. The respective bearing bracket is thereby inserted in an insertion direction through the respective insertion opening into the associated bearing receiving portion, wherein this insertion direction is aligned substantially perpendicular to the rotational axis. By using such a separate bearing bracket, the mounting function is separated from the housing. Such bearing brackets can in particular be produced with significantly narrower production tolerances than the comparatively large housing. The mounting of the control shaft can thus be improved with the help of such separate bearing brackets.

Preferably, a plurality of bearing brackets are used, thus two or more bearing brackets, which are in each case inserted into their own bearing receiving portion. The control shaft can thereby have a continuous, one-piece shaft body, which is formed, e.g. by means of a metallic bar, onto which the control valves made of plastic can be injected. Likewise, it is conceivable to provide a multi-piece shaft body for the control shaft, which is assembled from a plurality of bar-shaped sections. The individual shaft body sections can be fastened to one another, e.g. by means of injected control valves.

To solve the mentioned problem, provision can be made according to a first aspect according to the invention for the respective bearing bracket to be equipped with at least two positioning blocks, which interact with guide contours, which are complementary thereto and which are embodied in the corresponding bearing receiving portion, for the purpose of aligning the bearing bracket, when the bearing bracket is inserted into the bearing receiving portion. An optimal alignment of the mounting to the control shaft can thus be realized. A particularly low-friction mounting for the control shaft and thus a comparatively high functional reliability for the control shaft can in particular be realized.

In detail, it is proposed according to the first aspect according to the invention to equip the outside of the respective bearing bracket with two outer surfaces, which face away from one another with respect to a transverse direction, which runs substantially perpendicular to the rotational axis and substantially perpendicular to the insertion direction, and which in each case have at least one positioning block projecting therefrom. On its inside, the respective bearing receiving portion then has a guide contour, which is complementary thereto, for the respective positioning block for aligning the bearing bracket in a longitudinal direction, which runs parallel to the rotational axis, and in the transverse direction.

Advantageously, the respective positioning block is thereby integrally molded to the bearing bracket, is thus made from the same material.

An embodiment, in the case of which the respective bearing bracket, on its outer surfaces, is in contact with the housing only via these positioning blocks, is particularly advantageous. In addition or in the alternative, provision can be made for the respective bearing bracket, in particular in the longitudinal direction and/or in the transverse direction and/or in the insertion direction, to be in contact with the housing only via these positioning blocks. It is attained through this that the positioning of the bearing bracket relative to the housing in the longitudinal direction and/or in the transverse direction takes place only via these positioning blocks. Due to the fact that the positioning blocks can be dimensioned so as to be relatively small as compared to the entire bearing bracket, relatively narrow tolerances can also be adhered to in response to the injection molding in the area of the positioning blocks, because relatively little warping occurs at that location. A high-quality positioning can thus be attained, even if the bearing bracket is made inexpensively of plastic by means of injection molding. If the contact in the area of the outer surfaces is only made indirectly via the positioning blocks, a space or gap is embodied outside of the positioning blocks in the transverse direction and/or in the longitudinal direction between the outer surfaces of the respective bearing bracket and the inside of the corresponding bearing receiving portion.

Provision can generally be made for the respective bearing bracket in the longitudinal direction and/or in the transverse direction and/or in the insertion direction to be in direct contact with the housing only on the positioning blocks. A space between the outside of the bearing bracket and the inside of the bearing receiving portion is then preferably embodied outside of the positioning blocks.

Provision can advantageously be made for the respective positioning block to have a length, which is measured parallel to the longitudinal direction and which is smaller than a length of the bearing bracket, which is measured parallel to the longitudinal direction. In particular, the positioning block is maximally half as long as the bearing bracket. In addition or in the alternative, the respective positioning block can have a height, which is measured parallel to the insertion direction and which is smaller than a height of the bearing bracket, which is measured parallel to the longitudinal direction. In particular, the positioning block is maximally half as height as the bearing bracket.

Provision can further optionally be made for the respective positioning block to be in each case spaced apart from two longitudinal ends of the bearing bracket, which are spaced apart from one another in the longitudinal direction. In addition or in the alternative, provision can be made for the respective positioning block to be in each case spaced apart from two ends of the bearing bracket, which are spaced apart from one another in the insertion direction. When inserting the bearing bracket into the bearing receiving portion, one of these ends leads in the insertion direction and forms a front end of the bearing bracket, while the other end trails in the insertion direction and forms a rear end of the bearing bracket. By spacing apart the respective positioning blocks from the respective ends of the bearing bracket, a significantly smaller dimensioning results for the positioning block, which makes it possible to adhere to narrow tolerances at that location.

The respective positioning block is advantageously designed in the shape of a cuboid, so that it has at least four exterior preferably flat guide surfaces, namely one guide surface, which runs at right angles to the transverse direction and which faces away from the bearing bracket, at least one guide surface, which runs at right angles to the insertion direction and which leads in the insertion direction, and two guide surfaces, which run at right angles to the longitudinal direction and which face away from one another.

According to an advantageous embodiment, the respective positioning block can have two flat longitudinal positioning surfaces, which face away from one another with respect to the longitudinal direction and which extend parallel to one another and perpendicular to the longitudinal direction. On its inside, the corresponding bearing receiving portion advantageously has two flat longitudinal guide surfaces, which face one another with respect to the longitudinal direction and which extend parallel to one another and perpendicular to the longitudinal direction and against which one of the longitudinal positioning surfaces of the respective positioning block abuts in a flat manner in each case. This measure results in a particularly efficient and reliable alignment of the respective bearing bracket in the longitudinal direction. In other words, the rotational axis defined in the respective bearing bracket is aligned parallel to the longitudinal direction with the help of the longitudinal positioning surfaces and the longitudinal guide surfaces.

In the case of another advantageous embodiment, the respective positioning block can have a flat transverse positioning surface, which extends perpendicular to the transverse direction. On its inside, the corresponding bearing receiving portion can then advantageously have a flat transverse guide surface for the respective positioning block, which extends perpendicular to the transverse direction and against which the transverse positioning surface of the respective positioning block abuts in a flat manner. This measure results in an optimized alignment of the respective bearing bracket with respect to the transverse direction. In other words, the rotational axis defined by the respective bearing bracket is centered by means of the transverse positioning surfaces, which interact with the transverse guide surfaces.

According to the invention, the respective bearing bracket can have, on each of its two outer surfaces, at least two such positioning blocks, which are spaced apart from one another in the insertion direction. This results in a particularly efficient alignment of the bearing bracket inside the respective bearing receiving portion.

A further improvement results according to a further development, in the case of which, on the respective outer surface, at least two such positioning blocks are arranged so as to be aligned relative to one another in the insertion direction. The design of the corresponding guide contour inside the bearing receiving portion is thus simplified.

Provision can furthermore advantageously be made for the positioning block, which leads in the insertion direction, to be dimensioned so as to be smaller than the positioning block, which trails in the insertion direction. The positioning blocks thus interact separately with the corresponding guide contours, which improves a reliable alignment of the bearing bracket.

In the case of the leading or preceding positioning block, respectively, which is dimensioned so as to be smaller, provision can in particular be made for a distance of the longitudinal positioning surfaces measured parallel to the longitudinal direction, to be smaller than in the case of the trailing positioning block, which is dimensioned so as to be larger. Provision can furthermore be made for a distance of the transverse positioning surface measured parallel to the transverse direction from the respective outside of the bearing bracket in the case of the leading positioning block, which is dimensioned so as to be smaller, to be smaller than in the case of the trailing positioning block, which is dimensioned so as to be larger.

According to another advantageous embodiment, the one positioning block can be arranged in the insertion direction between the control shaft and the other positioning block. With the help of the respective bearing bracket, the control shaft can thus be inserted comparatively deeply into the flange section. In particular larger control valves can thus be used as well.

In the alternative, provision can be made in the case of another embodiment to arrange the control shaft between the two positioning blocks with respect to the insertion direction, whereby a particularly reliable alignment of the control shaft is possible.

In the case of another embodiment, the respective bearing bracket on both outer surfaces can in each case have at least two positioning blocks, which are spaced apart from one another in the longitudinal direction. While the bearing bracket as a whole can be constructed to be comparatively small or compact, respectively, in the longitudinal direction in the case of only one positioning block, the provision of at least two positioning blocks, which are spaced apart in the longitudinal direction, provides for a bearing bracket, which is constructed so as to be comparatively wide or large, respectively, based on the longitudinal direction. The larger the construction of the bearing bracket in the longitudinal direction, the more efficient the alignment of the bearing shaft. Larger mounting forces can further be supported in a wide bearing bracket. Advantageously, the two positioning blocks on the respective outer surface can be arranged so as to aligned with one another in the longitudinal direction.

In the case of another embodiment, at least one such positioning block can have, at each outer surface, a flat stop surface, which leads in the insertion direction and which extends perpendicular to the insertion direction and which abuts flat against a flat counter stop surface, which is embodied on the inner contour of the respective bearing bracket. The insertion depth of the bearing bracket is defined or is limited to a predetermined insertion depth, respectively, by means of the interaction of the respective stop surface with the corresponding counter stop surface. The bearing bracket is thus aligned with respect to the insertion direction. In other words, the rotational axis, which is defined with the help of the bearing bracket, is centered with respect to the insertion direction by the interaction of stop surface and counter stop surface.

According to a second aspect, which is not in accordance with the invention, provision can optionally be made for at least one such bearing bracket to be divided into at least two bearing part. The respective bearing bracket thus has a first bearing part and a second bearing part. The bearing bracket preferably only has two bearing parts, so that it is designed in two pieces. The at least two bearing parts of the divided bearing bracket can thereby form separate components. However, they can also be connected to one another in a movable manner, for example via an integral hinge. The bearing parts of the divided bearing bracket can in particular be made in one piece in a common injection molding tool, thus so as to be connected from the same material. It is important that the first bearing part can be moved relative to the second bearing part at least for the assembly of the bearing bracket relative to one another.

This second aspect, is based on the general idea of supporting the two bearing parts flat against one another at flat positioning surfaces, whereby a predetermined alignment of the two bearing parts relative to one another can be realized in a comparatively exact manner. The control shaft inside the bearing bracket can thus be mounted such that it can rotate in a reliable manner. An inadmissibly high radial compression of the control shaft in the bearing bracket can in particular be avoided, which can happen easily in the case of bearing parts, which are not aligned optimally. In this respect, the second aspect also leads to a simplified setup and in particular to an improved shaft bearing with a higher functional reliability.

In detail, the second aspect proposes to equip the first bearing part with a first bearing section, which defines a first circumferential section, against which the control shaft abuts in a flat manner, while the second bearing part has a second bearing section, which is located opposite the first bearing section and which defines a second circumferential section, which is located opposite the first circumferential section and against which the control shaft abuts in a flat manner. The two bearing parts further each have an inner surface, which face one another with respect to the transverse direction, which has already been mentioned above with regard to the first aspect and which runs substantially perpendicular to the rotational axis and substantially perpendicular to the insertion direction, and which in each case have at least one flat positioning surface, which extend substantially perpendicular to the transverse direction. As mentioned, at least one such positioning surface of the first bearing part abuts flat against at least one such positioning surface of the second bearing part.

According to an advantageous embodiment, the respective positioning surface can be raised with respect to the respective inner surface, can thus be spaced apart therefrom in the transverse direction. It can thus be attained that in the area of the inner surfaces, which face one another, the two bearing parts contact one another only on the positioning surfaces. It is not ruled out thereby that the two bearing parts are connected to one another for example via an integral hinge and/or can on principle also adjoin one another in the area of the bearing sections.

According to another advantageous embodiment, provision can be made for at least two such positioning surfaces to be embodied in each case on both bearing parts on the respective inner surface, which improves an optimal alignment of the two bearing parts relative to one another. Advantageously, the two positioning surfaces of the respective bearing part can be spaced apart from one another in the insertion direction. It is likewise conceivable to provide the two positioning surfaces to be spaced apart from one another in the longitudinal direction on the respective inner surface. It is likewise conceivable for more than two, for example three or four or more such positioning surfaces to be provided on the respective inner surface, wherein provision can in particular be made for at least two such positioning surfaces to be spaced apart from one another in the insertion direction and for two such positioning surfaces to be spaced apart from one another in the longitudinal direction. A spacing apart in the longitudinal direction is provided, when the respective bearing bracket is to be constructed to be comparatively large or wide in the longitudinal direction.

In the case of another embodiment, the first bearing part can have, on its inner surface, at least one guide pin, which projects in the transverse direction while the second bearing part has, on its inner surface, at least one guide opening, which is oriented in the transverse direction and which is complementary to the corresponding guide pin, and into which the corresponding guide pin is inserted in the transverse direction. A predetermined alignment of the two bearing parts relative to one another is also attained by means of the guide pin, which interacts with the respective guide opening. Guide pin and guide opening can furthermore again a sufficient fixation of the two bearing parts against one another in the case of a corresponding fit, which is preferably a press fit. Such a guide pin can preferably be formed integrally on the respective bearing part, can thus made from the same material.

According to an advantageous further development, the respective guide pin can be surrounded by the respective positioning surface, so that the respective guide pin projects from the respective bearing part inside the positioning surface. The respective guide opening can likewise be surrounded by the respective positioning surface. In this case, the guide opening inside the positioning surface is introduced into the respective bearing part. This results in a particularly compact construction for the bearing bracket.

In the case of another advantageous embodiment, the first bearing part can have at least two such guide pins, which are spaced apart from one another in the insertion direction and/or in the longitudinal direction. Complementary to the guide pins, the second bearing part then has at least two such guide openings, which are also spaced apart from one another in the insertion direction and/or in the longitudinal direction. This measure also leads to an improvement of the alignment of the two bearing parts relative to one another. A bearing bracket of large construction can thus likewise also be realized in the longitudinal direction.

Provision can further be made for the second bearing part to also have at least one guide pin, which is inserted into a guide opening embodied on the first bearing part. The guide pins, however, are preferably embodied only on the first bearing part, while the guide openings are only embodied on the second bearing part.

According to another advantageous embodiment, the first circumferential section or the second circumferential section can be larger than 180°, so that the bearing shaft inserted into the corresponding bearing section is clamped therein.

Advantageously, the first bearing section embodied on the first bearing part is formed in such a way that the first circumferential section is larger than 180°. The larger circumferential section extends for example across maximally 240° and can for example be approximately 200°.

A further embodiment follows when a gap is in each case provided in the circumferential direction between the first bearing section and the second bearing section. An alignment of the two bearing sections relative to one another can thus be realized by means of the contacting of the positioning surfaces against one another.

An embodiment, in the case of which the bearing parts do not contact one another in the area of the bearing sections, is particularly advantageous. An optimal alignment of the bearing sections relative to one another is thus possible by means of the interaction of the adjoining positioning surfaces. A functional separation inside the bearing bracket is also attained through this, because the positioning surface aligns the bearing sections relative to one another, while the bearing sections effect the mounting of the control shaft.

Another embodiment provides for the two bearing sections not to be of equal size, thus define circumferential sections of different sizes. Laterally on its inner surface, the bearing part comprising the larger bearing section has a projection, which enlarges the bearing section in the circumferential direction. Laterally on its inner surface, the bearing part comprising the smaller bearing section has a recess, which reduces the bearing section in the circumferential direction and with which the projection engages. This results in a particularly compact construction.

According to an advantageous further development, provision can be made for the two bearing parts not to contact one another in the area of the projection and of the recess. This measure also simplifies an alignment of the two bearing sections relative to one another, when the positioning surfaces come to rest against one another.

An embodiment, in the case of which the positioning surfaces adjoin one another in a positioning plane, in which the rotational axis is located as well, is particularly advantageous. The rotational axis can thus be centered with the help of the adjoining positioning surface.

A further advantageous embodiment with corresponding further development will also be described in more detail below, which can be combined in any manner with the features of the first aspect described further above and the embodiments thereof a well as in any manner with the features of the above-described second aspect and the embodiments thereof.

Said further embodiment assumes that, on its connection side, the flange section is equipped with at least one sealing groove for receiving a seal, wherein the seal abuts against the internal combustion engine so as to form a seal when the housing is connected to the internal combustion engine. According to said embodiment, it is now proposed to arrange at least one such bearing receiving portion in a section of the sealing groove in such a manner that the sealing groove has a groove break in the area of this sealing receiving portion. It is further proposed for at least one such bearing bracket to have, in the area of the sealing groove, a groove section, which completes the sealing groove in the area of the above-mentioned groove break. The groove section, which is embodied on the respective bearing bracket, can supplement the adjoining sealing groove quasi in an interruption-free and preferably flush manner in this way, so that the seal inserted therein can be guided in an interruption-free manner in the assembled state. This measure has the advantage that a distance in the longitudinal direction can be chosen to be particularly small, in particular between adjacent outlet openings. The control shaft can in particular also be inserted in the area of the seal by means of such a bearing receiving portion. A further advantage of this embodiment is seen that the bearing bracket, which is inserted into the bearing receiving portion, is captively held on the flange section with the help of the seal, namely by means of the sealing section, which is guided through the groove section. The intake module can thus be prepared largely completely as assembly, which simplifies the assembly thereof to the internal combustion engine. In the installed state, the compression of the seal generates a prestressing force, which drives the bearing bracket in the insertion direction into the bearing receiving portion, which also supports a reliable positioning of the bearing bracket relative to the housing.

According to an advantageous further development, at least one such positioning block can have a holding surface, which faces away from the control shaft and which adjoins a groove base of the groove section in a flush manner. With its holding surface, the respective positioning block also forms a section of the groove base of the sealing groove in this way, which also provides for a simplified assembly or an improved positioning, respectively, of the bearing bracket in the flange section.

In a preferred embodiment, the bearing bracket is formed as plastic injection molded part. The common draft angles for removing the finished plastic part from the injection molding tool are arranged on the outer surfaces, which are not provided for the positioning, as is common. Provision is not made on the positioning surfaces or guide pins, respectively, which are required for positioning of bearing bracket in the intake module or on the two bearing parts, respectively, for draft angles. These surfaces can thus be produced in a highly accurate manner and can thus also provide for a highly accurate mounting. The percentage of the positioning surfaces is less than 20%, in particular less than 10%, of the entire component surface. Due to the small percentage of the total surface, a removal of the injected bearing brackets from the tool is nonetheless possible without any problems.

According to an advantageous embodiment, provision can be made for both above-described aspects for the housing to have at least one inlet opening for fresh air and a flange section, which has the controllable openings, which form outlet openings for fresh air at that location. In addition or in the alternative, provision can be made for the bearing receiving portions to be embodied on a connection side of the flange section, which is provided for a connection of the housing to the internal combustion engine.

Further important features and advantages of the invention follow from the subclaims, from the drawings and from the corresponding figure description by means of the drawings.

It goes without saying that the above-mentioned features and the features, which will be explained below, cannot only be used in the respectively specified combination, but also in other combinations, or alone, without leaving the scope of the invention at hand.

Preferred exemplary embodiments of the invention are illustrated in the drawings and will be discussed in more detail in the description below, whereby the same reference numerals refer to the same or to similar or to functionally identical components.

BRIEF DESCRIPTION OF THE DRAWINGS

In each case schematically

DETAILED DESCRIPTION

Figure 1:
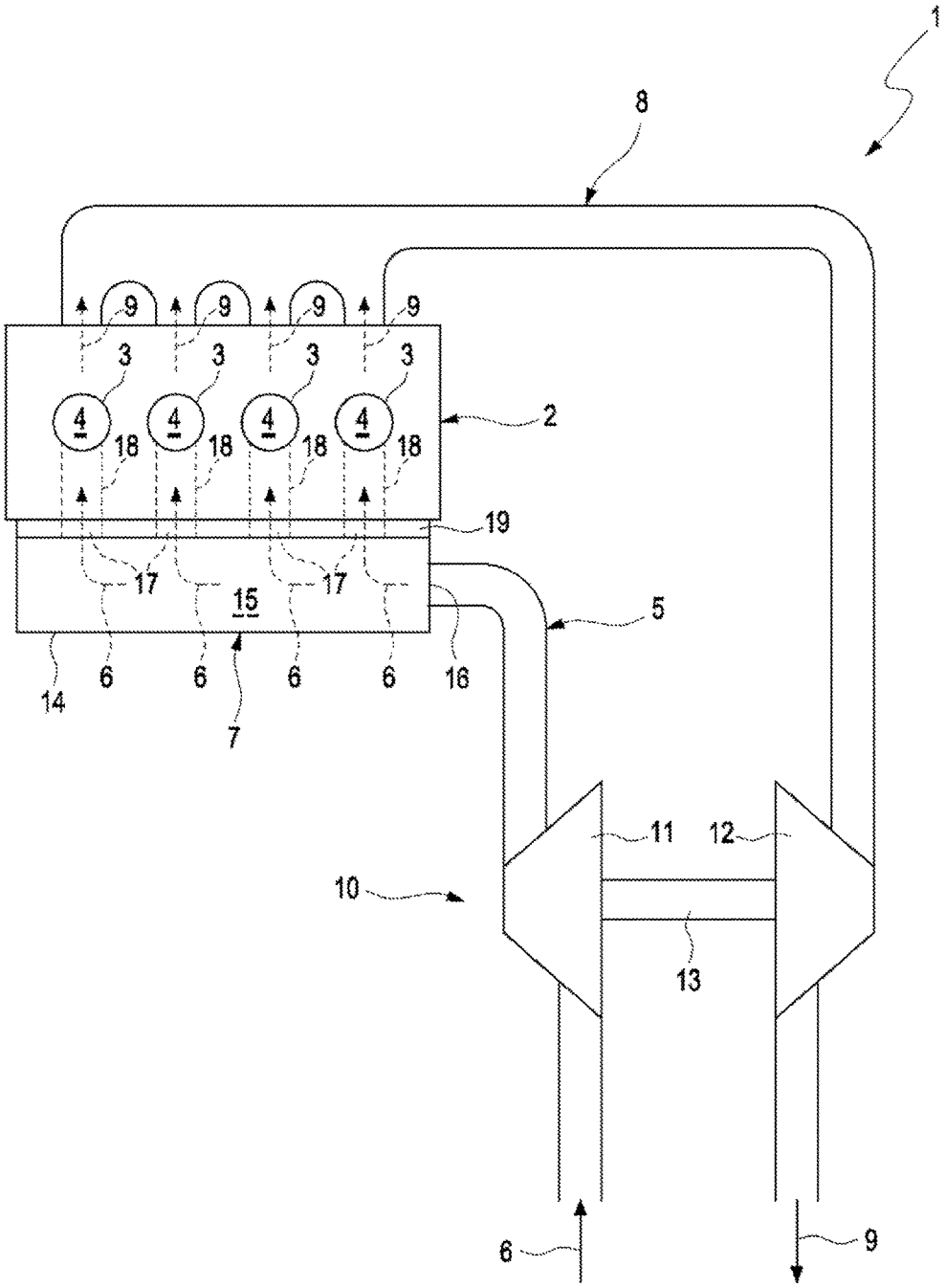
FIG. 1 shows a highly simplified, circuit diagram-like schematic diagram of an internal combustion engine comprising a fresh air system, which has an intake module.

According to FIG. 1, an internal combustion engine 1 comprises an engine block 2, which has a plurality of cylinders 3, in which a combustion chamber 4 of the internal combustion engine 1 is in each case included. Four cylinders are illustrated here merely in an exemplary manner and without limiting the generality. In the case of an internal combustion engine 1, which is embodied as piston engine, a piston, which is not shown herein, is arranged in each cylinder 3 in a stroke-adjustable manner. Fresh air is supplied to the combustion chambers 4 via a fresh air system 5. A corresponding fresh air flow 6 is suggested by arrows. The fresh air system 5 is connected to the internal combustion engine 1 or to the engine block 2, respectively, or is fastened thereto, respectively, via an intake module 7. Provision is further made for an exhaust system 8, via which the combustion exhaust gases can be discharged from the combustion chambers 4. A corresponding exhaust gas flow 9 is suggested by arrows.

In the shown example of FIG. 1, the internal combustion engine 1 is a charged internal combustion engine 1, because it is equipped with a charging station 10, which, in the example, is an exhaust gas turbocharger, which can also be identified with 10 hereinafter. The exhaust gas turbocharger 10 has a compressor 11 in the usual way, which is installed in the fresh air system 5, as well as a turbine 12, which is installed in the exhaust gas system 8. Compressor 11 and turbine 12 are drive-connected to one another for example by means of a common drive shaft 13. In the alternative, the internal combustion engine 1 can also be designed as non-charged internal combustion engine 1, thus as intake motor.

Figure 2:
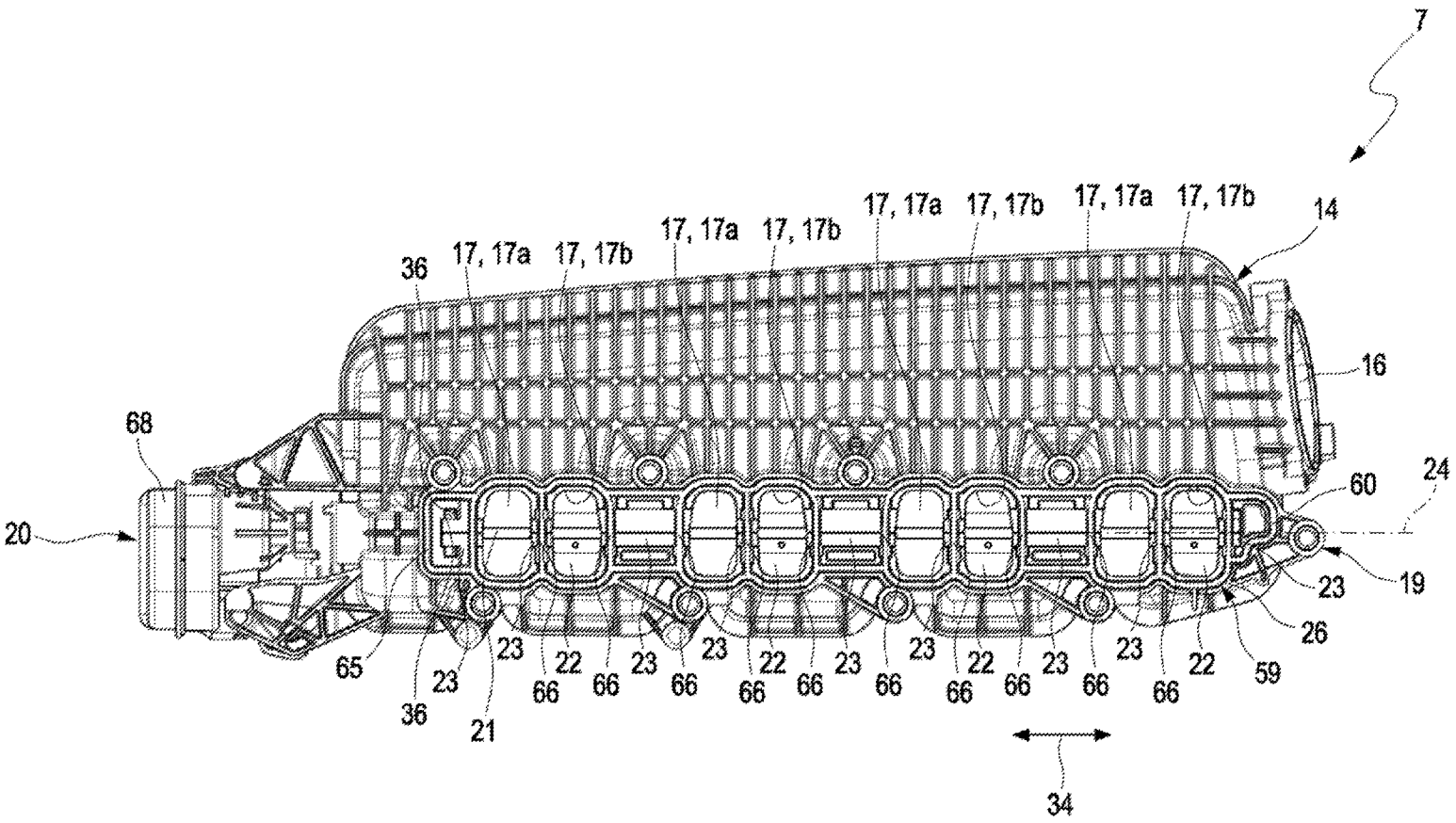
FIG. 2 shows a view from below onto the intake module, FIGS. 3 to 5 in each case show an isometric view onto a bearing bracket in an open state, in the case of different embodiments, FIGS. 6 and 7 in each case show an isometric view onto the bearing bracket in a collapsed state, in the case of the embodiments shown in FIGS. 4 and 5.

According to FIGS. 1 and 2, the intake module 7 has a housing 14, which surrounds a distribution chamber 15. The housing 2 has an inlet opening 16 as well as a plurality of outlet openings 17. The fresh air flow 6 can enter into the distribution chamber 15 through the inlet opening 16. The fresh air flow 6 can escape from the distribution chamber 15 through the outlet openings 17 and can flow into the respective combustion chamber 4 via corresponding fresh air ducts 18, which are formed in the engine block 2. Gas exchange valves for controlling gas exchange processes are not illustrated here.

The housing 14 has a flange section 19, with which the housing 14 or the intake module 7, respectively, can be fastened to the engine block 2 or can be connected to the internal combustion engine 1, respectively. Advantageously, the flange section 19 is integrally molded on the housing 14, is thus made from the same material therewith.

According to FIG. 2, the intake module 7 is furthermore equipped with a control device 20, with the help of which the cross section, through which flow can pass, can be controlled at least in the case of one of the outlet openings 17. It is clear that in the case of another embodiment, the cross section, through which flow can pass, of any other opening can be controlled by means of the control device 20, so that the following description can accordingly also be read on an intake module 7 comprising other controllable openings.

In the example of FIG. 2, two outlet openings 17 are assigned to each cylinder 3 or to each combustion chamber 4, respectively, wherein only one of these two outlet openings 17 can in each case be controlled with the help of the control device 20, while the respective other outlet opening 17 is uncontrolled, is thus permanently open. The uncontrolled outlet openings 17 are furthermore identified with 17*a* in FIG. 2. The outlet openings 17, which can be controlled or which are controlled, respectively, with the help of the control device 20, are furthermore identified with 17*b* in FIG. 2. The control device 20 has at least one control shaft 21, which supports a control valve 22 for at least one controlled outlet opening 17*b* and which is arranged on the control shaft 21 in a rotationally-fixed manner. For driving the control shaft 21 in a rotating manner, provision is made for a corresponding actuator 68. In the example of FIG. 2, all controllable outlet openings 17*b* are provided with a single, common control shaft 21, which in each case supports a control valve 22 for all of the controllable outlet openings 17*b*. While the control shaft 21 is advantageously made of a metal, the control valves 22 are preferably made of a plastic, wherein the control valves 22 can be injected directly against the control shaft 21.

The control shaft 21 is mounted on the housing 14 such that it can rotate about a rotational axis 24. Advantageously, the control shaft 21 is embodied so as to be straight, so that the rotational axis 24 extends concentrically to the control shaft 21.

Figure 8:
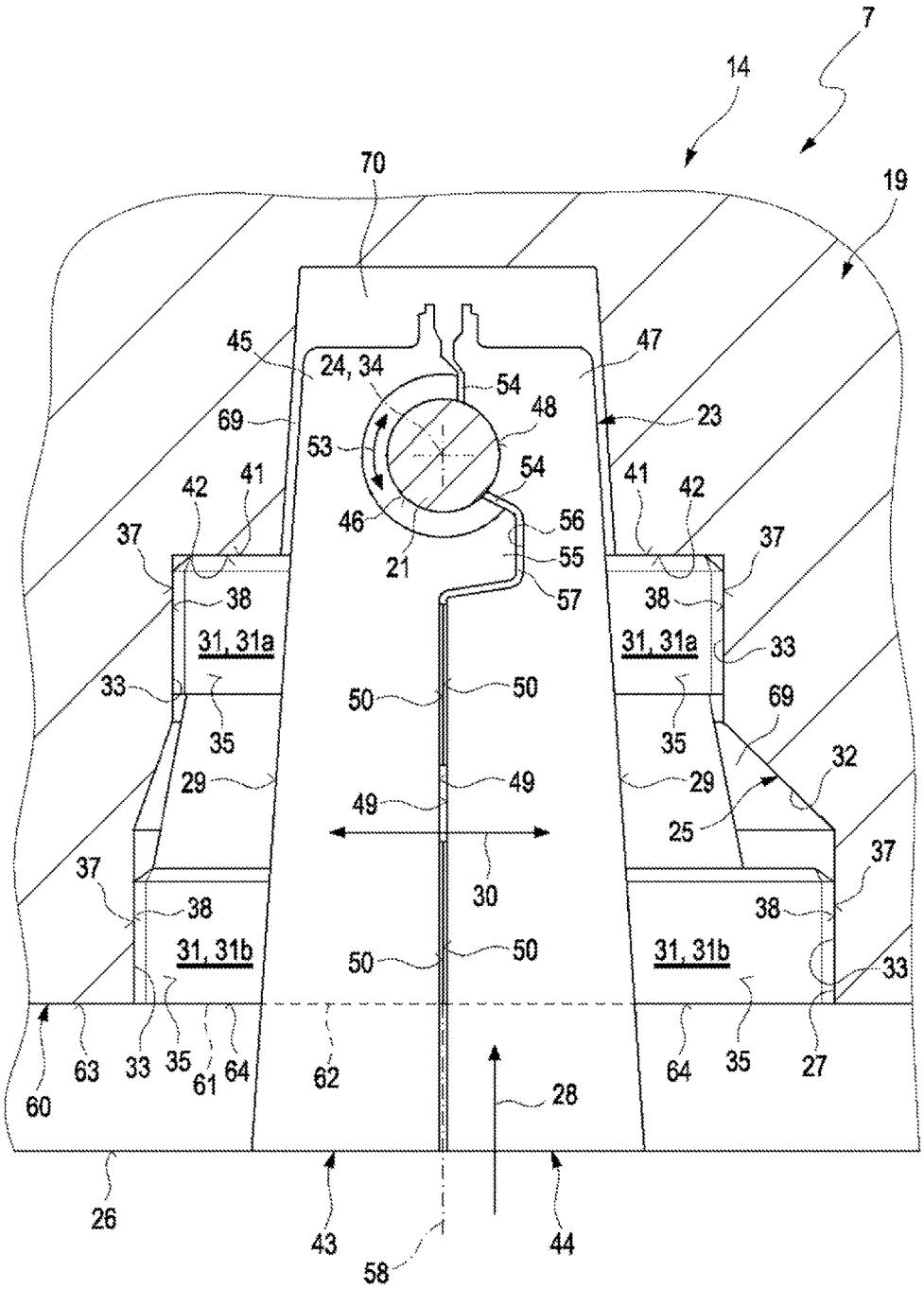
FIG. 8 shows a cross section of the intake module in the area of a bearing bracket, wherein a housing of the intake module is illustrated in section, while the bearing bracket is reproduced in a side view.

FIG. 8 reflects a simplified cross section of the intake module 7 through the housing 14 in the area of the flange section 19 perpendicular to the rotational axis 24, namely in the area of such a bearing bracket 23, wherein the bearing bracket 23 itself is not illustrated in section, but in a side view, the viewing direction of which runs parallel to the rotational axis 24. As can be seen, the housing 14 has a corresponding bearing receiving portion 25 for each bearing bracket 23 in the area of the flange section 19 on a connection side 26 of the flange section 19, the respective bearing receiving portion 25 has an insertion opening 27, so that the respective bearing receiving portion 25 is open on the connection side 26. The connection side 26 serves to connect the housing 14 to the internal combustion engine 1 or to the engine block 2 thereof, respectively, wherein the connection side 26 faces the engine block 2 or is arranged on a side of the connecting flange 19, which faces away from the housing 14, respectively. The respective bearing bracket 23 is inserted into the bearing receiving portion 25 in an insertion direction 28, which is suggested by an arrow, through the insertion opening 27. The insertion direction 28 is thereby oriented perpendicular to the rotational axis 24.

Figure 6:
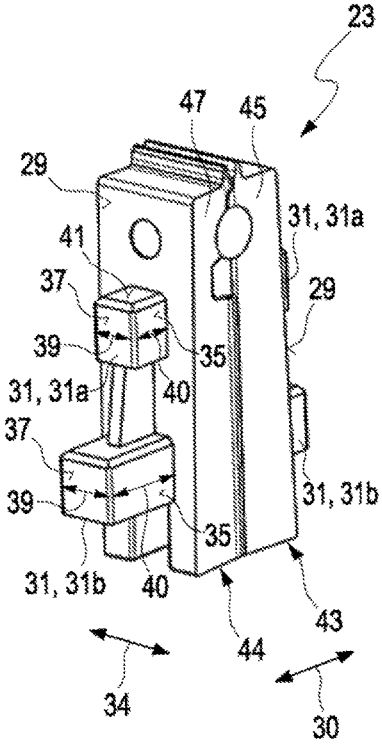
Figure 7:
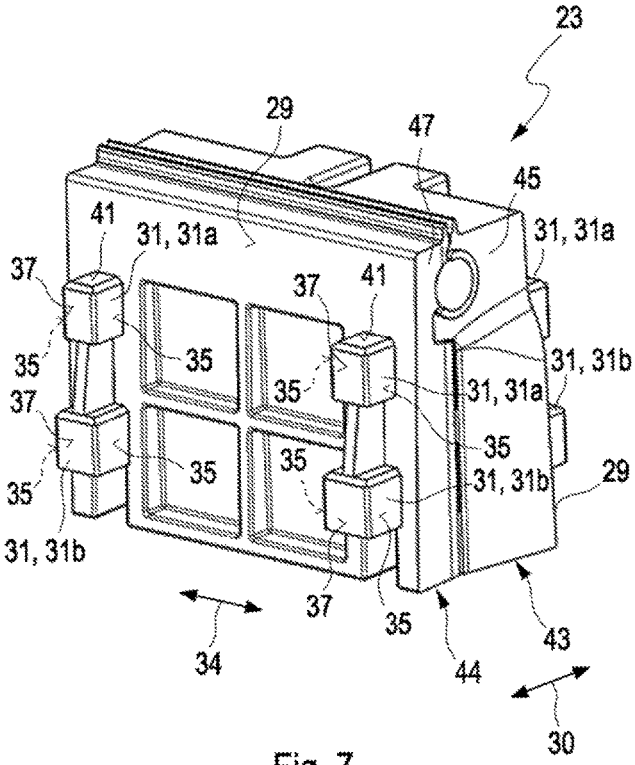

According to FIGS. 6 to 8, the respective bearing bracket 23 has, on its outside, two outer surfaces 29, which face away from one another with respect to a transverse direction 30, which is suggested by a double arrow in FIGS. 6 to 8. The transverse direction 30 runs perpendicular to the rotational axis 24 and perpendicular to the insertion direction 28.

At each of these two outer surfaces 29, the bearing bracket 23 in each case has at least one positioning block 31, which projects away from the respective outer surface 29. Complementary to the positioning blocks 31, the bearing receiving portion 25, on its inside 32, has a guide contour 33 for aligning the bearing bracket 23 with respect to the transverse direction 30 and with respect to a longitudinal direction 34, which is in each case suggested by a double arrow in FIGS. 6 and 7 and which extends parallel to the rotational axis 24. The respective positioning block 31 has two flat longitudinal positioning surfaces 35, which face away from one another with respect to the longitudinal direction 34, and which extend parallel to one another and perpendicular to the longitudinal direction 34. Only the longitudinal positioning surfaces 35, which face the observer, can thereby be seen in each case in FIGS. 6 to 8. The longitudinal positioning surfaces 35 facing away from the observer are suggested with dashed reference lines in FIG. 7.

On the inside 32, the bearing receiving portion 25 or the respective guide contour 33, respectively, has two flat longitudinal guide surfaces 36 for the respective positioning block 31, which can only be seen in FIG. 2. The longitudinal guide surfaces 36 face one another with respect to the longitudinal direction 34 and extend parallel to one another as well as perpendicular to the longitudinal direction 34. In the installed state, the longitudinal positioning surfaces 35 of the respective positioning block 31 abut flat against the respective longitudinal guide surface 36 in a flat manner.

The respective positioning block 31 is here further equipped with a flat transverse positioning surface 37, which extends perpendicular to the transverse direction 30 and which thereby faces away from the remaining bearing bracket 23 with respect to the transverse direction 30. Complementary to these transverse positioning surfaces 37, the bearing receiving portion 25 has, on its inside 32 or on its guide contour 33, respectively, for the respective positioning block 31, a flat transverse guide surface 38, which extends perpendicular to the transverse direction 30 and which abuts against the respective transverse positioning surface 38 of the respective positioning block 31 in a flat manner. While the above-mentioned longitudinal poisoning surfaces 35 effect an alignment of the bearing bracket 23 with respect to the longitudinal direction 34 with the longitudinal guide surfaces 36, the transverse positioning surfaces 37, in connection with the transverse guide surfaces 38, effect an alignment of the bearing bracket 23 with respect to the transverse direction 30.

In the examples shown herein, the respective bearing bracket 23 has, on each of its two outer surfaces 29, at least two such positioning blocks 31, which are spaced apart from one another in the insertion direction 28. To differentiate the two positioning blocks 31, the positioning block 31, which leads in response to the insertion of the bearing bracket 23 into the bearing receiving portion 25, can hereinafter be identified as leading or as preceding positioning block 31*a*, while the positioning block 31, which trails in response to the insertion, can hereinafter also be identified as trailing positioning block 31*b*. Advantageously, the two positioning blocks 31*a*, 31*b* are arranged so as to be aligned with one another on the respective outer surface 29 in the insertion direction 28. The leading positioning block 31*a* is thereby dimensioned so as to be smaller than the trailing positioning block 31*b*. Advantageously, the smaller leading positioning block 31*a* is dimensioned so as to be smaller than the larger, trailing positioning block 31*b*, both in the longitudinal direction 34 and in the transverse direction 30. According to FIG. 6, for example, a longitudinal distance 39, which the two longitudinal positioning surfaces 35 of the respective positioning block 31 have from one another, is smaller in the case of the leading positioning block 31*a* than in the case of the trailing positioning block 31*b*. A transverse distance 40, which is measured parallel to the transverse direction 30, of the respective transverse positioning surface 37 from the corresponding outer surface 29, from which the respective positioning block 31 projects, is further smaller in the case of the leading positioning block 31*a* than in the case of the trailing positioning block 31*b*.

In the case of the embodiments shown herein, the leading positioning block 31*a* is arranged between the control shaft 21 and the trailing positioning block 31*b* with respect to the insertion direction 28, whereby the control shaft 21 can reach a particularly large distance from the connection side 26, which corresponds to a large penetration depth. This is advantageous for realizing comparatively large control valves 22.

While the embodiment of the bearing bracket 23 shown in FIG. 6 only has two positioning blocks 31 on each outside 29, four such positioning blocks 31 are provided on each outside 29 in the case of the embodiment shown in FIG. 7. At least two such positioning blocks 31 are thus spaced apart from one another in the longitudinal direction 34 at the respective outer surface 29. In detail, provision is made for two leading smaller positioning blocks 31*a*, which are spaced apart from one another in the longitudinal direction 34, and for two trailing larger positioning blocks 31*b*.

In the case of the bearing brackets 23 introduced here, provision is furthermore made that at least in the case of one of the positioning blocks 31, namely in each case in the case of the leading positioning block 31*a*, a flat stop surface 41, which leads in the insertion direction 28 and which extends perpendicularly to the insertion direction 28, is embodied. Complementary thereto, the bearing receiving portion 25, on its inside 32 for the respective positioning block 31, here for the respective leading positioning block 31*a*, has a flat counter stop surface 42, against which the stop surface 41 abuts in a flat manner, as soon as the bearing bracket 23 has reached a predetermined insertion depth in the bearing receiving portion 25.

It can also be gathered from FIGS. 6 to 8 that the respective bearing bracket 23, on its outer surfaces 29, is only in contact with the housing 14 via these positioning blocks 31. It is attained through this that the positioning of the bearing bracket 23 relative to the housing 14 in the longitudinal direction 34 and in the transverse direction 30 only takes place via these positioning blocks 31. As can be seen, the positioning blocks 31 are dimensioned so as to be relatively small as compared to the total bearing bracket 23. If the contact in the area of the outer surfaces 29 only takes place indirectly, namely via the positioning blocks 31, as shown in FIG. 8, a space or gap is embodied outside of the positioning blocks 31 in the transverse direction 30 and/or in the longitudinal direction 34 between the outer surfaces 29 of the respective bearing bracket 23 and the inside 32 of the corresponding bearing receiving portion 25. Such spaces, which are identified with 69, are present on both outer sides of the bearing bracket 23 outside of the positioning blocks 31 in the transverse direction 30 in FIG. 8. It can further be seen that the bearing bracket 23 outside of the positioning blocks 31 also does not have a direct contact to the housing 14 in the insertion direction 28 between the leading front end and an opposite wall of the housing 14, which defines the bearing bracket 25, so that a space 70 is also located at this position.

In the case of the examples of FIGS. 3 to 8 shown herein, provision is advantageously furthermore made for the respective positioning block 31 to have a length measured parallel to the longitudinal direction 34, which is smaller than a length of the bearing bracket 23, which is measured parallel to the longitudinal direction 34. As can be seen, the positioning block 31 in the longitudinal direction 34 is maximally half as long as the bearing bracket 23. Provision is additionally made here for the respective positioning block 31 to have a height, which is measured parallel to the insertion direction 28, which is smaller than a height of the bearing bracket 23, which is measured parallel to the longitudinal direction. The positioning block 31 is in particular maximally half as high here as the bearing bracket 23.

Provision is further also made here for the respective positioning block 31 to be in each case spaced apart from two longitudinal ends of the bearing bracket 23, which are spaced apart from one another in the longitudinal direction 23. Provision is additionally made here for the respective positioning block 31 to be in each case spaced apart from two ends of the bearing bracket 23, which are spaced apart from one another in the insertion direction 28. When inserting the bearing bracket 23 into the bearing receiving portion 25, one of these ends leads in the insertion direction 28 and forms a front end of the bearing bracket 23, while the other end trails in the insertion direction 28 and forms a rear end of the bearing bracket 23. By spacing apart the respective positioning block 31 from the respective ends of the bearing bracket 23, a significantly smaller dimensioning results for the positioning block 31, which makes it possible to adhere to narrow tolerances at that location.

The respective positioning block 31 is advantageously designed in the shape of a cuboid, so that it has at least four exterior preferably flat guide surfaces, namely one guide surface 37, which runs at right angles to the transverse direction 30 and which faces away from the bearing bracket 23, a guide surface 41, which runs at right angles to the insertion direction 28 and which leads in the insertion direction 28, and two guide surfaces 35, which run at right angles to the longitudinal direction 34 and which face away from one another.

In addition or in alternative to the above-described features, the respective bearing bracket 23 has two bearing parts, namely a first bearing part 43 and a second bearing part 44. The first bearing part 43 has a first bearing section 45, against which the control shaft 27 abuts with a first circumferential section 46. The second bearing part 44 has a second bearing section 47, which is located opposite the first bearing section 45 and against which the control shaft 21 abuts with a second circumferential section 48, which, in turn, is located opposite the first circumferential section 46. Laterally adjoining the respective bearing section 45, 47, both bearing parts 43, 44 in each case have an inner surface 49, which face one another with respect to the transverse direction 30. On the respective inner surface 49, at least one flat positioning surface 50 is in each case embodied, which in each case extends perpendicular to the transverse direction 30. In the collapsed state of FIGS. 6 to 8 or in the installed state of FIG. 8, respectively, the respective positioning surface 50 of the first bearing part 43 abuts flat against at least one positioning surface 50 of the second bearing part 44. The two bearing parts 43, 44 are thus aligned optimally relative to one another with respect to the transverse direction 30.

The positioning surfaces 50 of the two bearing parts 43, 44 adjoin one another in a positioning plane 58. Advantageously, the positioning surfaces 50 are thereby arranged on the bearing parts 43, 44 in such a way that the rotational axis 24 defined by the bearing bracket 43 is located in the positioning plane 58.

Figure 3:
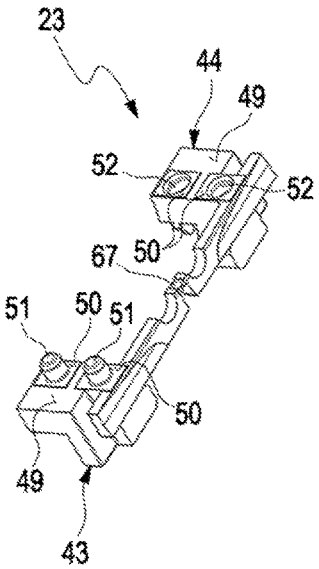
Figure 4:
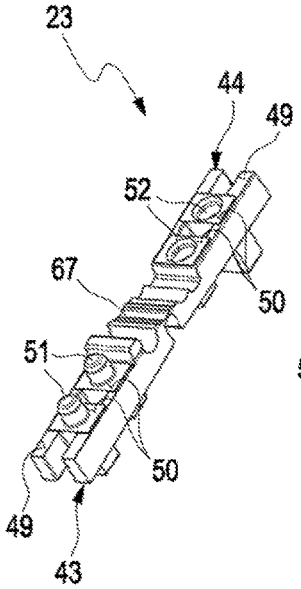
Figure 5:
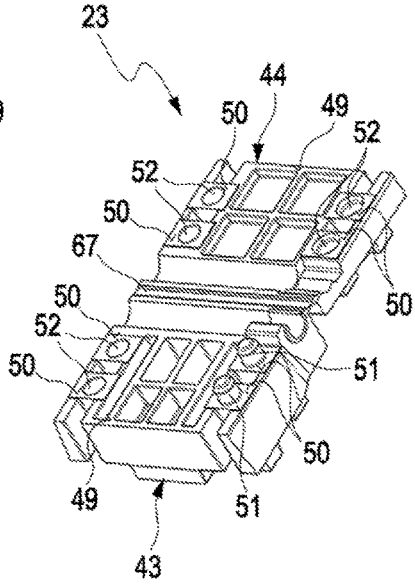

According to FIGS. 3 to 5, the first bearing part 43 has, on its inner surface 49, at least one guide pin 51, which projects in the transverse direction 30. In the collapsed state of FIGS. 6 to 8, these guide pins 51 cannot be seen. According to FIGS. 3 to 5, the respective second bearing part 43 has, on its inner surface 49, at least one guide opening 52, which is oriented in the transverse direction 30 and which is formed complementary to the corresponding guide pin 51. In the collapsed state of FIGS. 6 to 8, the respective guide pin 51 is inserted into the corresponding guide opening 52 in the transverse direction 30. The guide openings 52 can also not be seen in FIGS. 6 to 8.

Advantageously, the guide pins 51 are positioned systematically on the respective inner surface 49 in such a way that the respective guide pin 51 is surrounded by the respective positioning surface 50 and is in particular centered thereto. The positioning openings 52 on the second bearing part 44 are correspondingly also surrounded by the respective positioning surface 50 and are in particular centered thereto. As can be gathered from FIGS. 3 to 5 and 8, the respective positioning surface 50 is raised from the corresponding inner surface 49, thus spaced apart therefrom in the transverse direction 30.

In the case of the embodiments shown here, at least two such positioning surfaces 50, which can be arranged spaced apart from one another in the insertion direction 28 and/or in the longitudinal direction 34, are in each case embodied on both bearing parts 43, 44 on the respective inner surface 49. FIG. 3 show an embodiment, in the case of which the respective bearing part 43, 44 has exactly two positioning surfaces 50, which are spaced apart from one another in the longitudinal direction 34 and which are also arranged so as to be aligned to one another with respect to the longitudinal direction 34. In the case of the embodiment shown in FIG. 4, provision is also in each case made on the two bearing parts 43, 44 for only two positioning surfaces 50, but which are spaced apart from one another in the insertion direction 28 in this case and which are also arranged aligned relative to one another in the insertion direction 28. In contrast, FIG. 5 shows an example, in the case of which the respective bearing part 43, 44 in each case has four positioning surfaces 50, wherein two are in each case spaced apart from one another in the insertion direction 28 and two are in each case spaced apart from one another in the longitudinal direction 34 and are arranged so as to be aligned relative to one another. In the case of the examples of FIGS. 3 to 5, provision is in each case made for exactly two guide pins 51 and for exactly two guide openings 52.

As can also be gathered particularly clearly from FIG. 8, the first circumferential section 46, which is defined by the first bearing section 45 of the first bearing part 43 in the case of the embodiments of the bearing brackets 23 shown herein is in each case larger than 180° and is approximately 225° in the example. In contrast, the second circumferential section 48 defined by the second bearing section 47 of the second bearing part 44 is smaller than 180° and is approximately 120° in the shown example. The control shaft 21 can thus be clipped to the first bearing section 45, while the second bearing section 47 in the collapsed state of the bearing bracket 23 secures the control shaft 21 in the first bearing section 45. In the case of the example shown here, provision is furthermore made for the sum of first circumferential section 46 and second circumferential section 48 to be smaller than 360°. The two bearing sections 45, 47 are further positioned relative to one another in such a way that a gap 54 is in each case formed in the circumferential direction 53 suggested in FIG. 8 by means of a double arrow of the control shaft 21 between the first bearing section 45 and the second bearing section 47, so that the bearing parts 43, 44 do not contact one another in the area of the bearing sections 45, 47. A projection 55, which enlarges the first bearing section 45 in the circumferential direction 53, is embodied on the first bearing part 53 in the area of the first bearing section 45, so that the projection 55 covers or defines, respectively, a part of the first circumferential section 46. In the area of the second bearing section 47, the second bearing part 44 has a recess 56, thus a depression or recess. The recess 56 leads to a reduction of the second circumferential section 48. The projection 55 further engages with this recess 56. The positioning of the projection 55 in the recess 56 is thereby designed in such a way that the two bearing parts 43, 44 also do not contact one another in the area of the projection 55 and of the recess 56. In fact, a gap 57 is also embodied at that location between projection 55 and recess 56.

According to FIG. 2, the flange section 19 is equipped on its connection side 26, which faces the observer, with a seal 59, with the help of which the flange section 19 or the housing 14, respectively, is sealed against the engine block 2 in the assembled state, in order to avoid a leakage of the fresh air supplied to the combustion chamber 4 into the environment. To receive the seal 59, a sealing groove 60, which is formed complementary to the seal 59 and of which a section can also be seen in FIG. 8, is incorporated into the connection side 26 of the flange section 19. Advantageously, provision can now be made for at least one such bearing receiving portion 25 to be arranged in a section of the sealing groove 60 in such a way that the sealing groove 60 has a groove break 61 in the area of this bearing receiving portion 25. The bearing bracket 23, which is inserted into this bearing receiving portion 25, is now designed in such a way that, in the area of the sealing groove 60, it has a groove section 62, which completes the sealing groove 60 in the area of the groove break 61. Advantageously, the groove section 62 provided on the bearing bracket 23 completely supplements the sealing groove 60 in the area of the groove break 61, so that the seal 59 can come to rest on a groove base 63 of the sealing groove 60 without any gaps. Provision is furthermore made in the example of FIG. 8 for the two subsequent positioning blocks 31*b* to in each case have a holding surface 64, which faces away from the control shaft 21 and which are flush with the groove base 53 of the groove section 60 and thus form a section of the groove base 63 of the sealing groove 60. On principle, it is thus possible to also establish a continuous contact with the seal 59 in the area of the groove break 61. According to FIG. 2, the seal 59 has a circulation 65, which is guided around all outlet openings 17 and around all bearing receiving portions 25, which thus surrounds or encloses them, respectively. Inside this circulation 65, the seal 59 has a plurality of webs 66, which are in each case guided through a groove break 61, thus through a bearing receiving portion 25 and are in contact with the corresponding bearing bracket 23 at that location. During the preassembly of intake module 7, these webs 66 are used to secure the bearing brackets 23 inserted into the bearing receiving portions 25 on the flange section 19. In the attached state of the intake system 7, the webs 66 effect a prestressing of the bearing brackets 23 in the insertion direction 28, whereby the bearing brackets 23 in particular come to rest with their stop surfaces 41 on the counter stop surfaces 42 in a prestressed manner.

As can be gathered from FIGS. 3 to 5, the two bearing parts 43, 44 can preferably be produced in a common injection molding tool. The two bearing parts 43, 44 can thereby be produced in one piece, but so as to be movably connected to one another. For this purpose, for example an integral hinge 67 can be embodied at the transition between the two bearing parts 43, 44. The one-piece production of the two bearing parts 43, 44 ensures that such bearing parts 43, 44, which were made from identical material and under identical production conditions, are always assembled to form a bearing bracket 23. The integral hinge 67 can be designed in such a way that it provides for a pivoting movement of the two bearing parts 43, 44 relative to one another about a pivot axis, which runs parallel to the rotational axis 24 and which is defined by the integral hinge 67, in order to form the respective bearing bracket 23 or in order to create the collapsed state of the bearing bracket 23, respectively. For assembly of the control device 20, the required bearing brackets 23 can thus be clipped with their first bearing parts 43 at the corresponding positions onto the control shaft 21 in the open state as shown in FIGS. 3 to 5. The bearing brackets 23 can subsequently be transferred into the closed state as shown in FIGS. 6 to 8, in which the respective second bearing part 44 is pivoted about the integral hinge 67 or about the pivot axis thereof, respectively, until the positioning surfaces 50 come to rest against one another. The guide pins 51 are hereby also inserted into the guide openings 52. Provision can be made thereby to dimension the integral hinge 67 in such a way that it is destroyed when assembling the two bearing parts 43, 44 into the bearing bracket 23 (collapsed), so that the two bearing parts 43, 44 are no longer connected to one another via the integral hinge 67 after the assembly or after collapsing the bearing bracket 23, respectively. FIGS. 6 to 8 show such embodiments, in the case of which the integral hinge 67 is destroyed or is no longer present, respectively, after collapsing the bearing bracket 23. In the alternative, the film hinge 67 can also be dimensioned in such a way that it is not destroyed by collapsing the bearing bracket 23, but creates a spring-elastic connection between the two bearing parts 43, 44, so that the bearing sections 45, 47 can be adjusted relative to one another when collapsing the bearing parts 43, 44 and so that an alignment of the two bearing sections 45, 47 relative to one another is not impeded by the integral hinge 67.

The invention claimed is:

1. An intake module of a fresh air system for an internal combustion engine, comprising:

a housing having a plurality of openings through which fresh air is flowable;

a control device for controlling a cross section, through which flow can pass, of at least one of the openings;

wherein the control device has at least one control shaft and at least one control valve, which is arranged on the at least one control shaft in a rotationally fixed manner, for the at least one opening;

wherein the at least one control shaft is mounted on the housing by at least one bearing bracket such that the at least one control shaft is rotatable about a rotational axis;

wherein the housing has at least one bearing receiving portion for receiving the at least one bearing bracket;

wherein the at least one bearing receiving portion has an insertion opening;

wherein the at least one bearing bracket is inserted in an insertion direction, which is oriented perpendicular to the rotational axis, through the insertion opening into the at least one bearing receiving portion;

wherein the at least one bearing bracket has on an outside thereof two outer surfaces, which face away from one another with respect to a transverse direction, which runs perpendicular to the rotational axis and perpendicular to the insertion direction;

wherein, on each outer surface, the at least one bearing bracket has at least two positioning blocks projecting therefrom in the transverse direction and spaced apart from one another with a space therebetween in the insertion direction;

wherein the at least one bearing receiving portion has on an inside thereof a guide contour, which is complementary thereto, for each positioning block for aligning the at least one bearing bracket in a longitudinal direction, which runs parallel to the rotational axis, and in the transverse direction.

2. The intake module according to claim 1, wherein the at least one bearing bracket, on the outer surfaces, is in contact with the housing only via the positioning blocks.

3. The intake module according to claim 1, wherein the at least one bearing bracket in at least one of the longitudinal direction, the insertion direction, and the transverse direction is in contact with the housing only via the positioning blocks.

4. The intake module according to claim 1, wherein at least one of:

each positioning block has a length, which is measured parallel to the longitudinal direction and which is smaller than a length of the at least one bearing bracket, which is measured parallel to the longitudinal direction; and each positioning block has a height, which is measured parallel to the insertion direction and which is smaller than a height of the at least one bearing bracket, which is measured parallel to the insertion direction.

5. The intake module according to claim 1, wherein at least one of:

each positioning block is spaced apart from two longitudinal ends of the at least one bearing bracket, which are spaced apart from one another in the longitudinal direction; and each positioning block is spaced apart from two other ends of the at least one bearing bracket, which are spaced apart from one another in the insertion direction.

6. The intake module according to claim 1, wherein each positioning block has one guide surface, which runs at a right angle to the transverse direction and faces away from the at least one bearing bracket, at least one guide surface, which runs at a right angle to the insertion direction and leads in the insertion direction, and two guide surfaces, which run at right angles to the longitudinal direction and which face away from one another.

7. The intake module according to claim 1, wherein:

each positioning block has two flat longitudinal positioning surfaces, which face away from one another with respect to the longitudinal direction and which extend parallel to one another and perpendicular to the longitudinal direction; and the at least one bearing receiving portion on the inside thereof has two flat longitudinal guide surfaces, which face one another with respect to the longitudinal direction and which extend parallel to one another and perpendicular to the longitudinal direction and against which one of the longitudinal positioning surfaces of each positioning block abuts in a flat manner.

8. The intake module according to claim 1, wherein:

each positioning block has a flat transverse positioning surface, which extends perpendicular to the transverse direction; and the at least one bearing receiving portion has on the inside thereof a flat transverse guide surface for each positioning block, which extends perpendicular to the transverse direction and against which the transverse positioning surface of each positioning block abuts in a flat manner.

9. The intake module according to claim 1, wherein:

on each outer surface, the at least two positioning blocks are aligned relative to one another in the insertion direction; and the one of the at least two positioning blocks that leads in the insertion direction is smaller than the other of the at least two positioning blocks that trails in the insertion direction.

10. The intake module according to claim 9, wherein the one of the at least two positioning blocks is arranged between the at least one control shaft and the other of the at least two positioning blocks in the insertion direction.

11. The intake module according to claim 1, wherein at least one of the positioning blocks at each outer surface has a flat stop surface, which leads in the insertion direction and which extends perpendicular to the insertion direction and which abuts flat against a flat counter stop surface, which is embodied on the inside of the at least one bearing receiving portion.

12. The intake module according to claim 1, wherein:

the at least one bearing bracket has a first bearing part and a second bearing part;

the first bearing part has a first bearing section against which the at least one control shaft abuts with a first circumferential section;

the second bearing part has a second bearing section, which is located opposite the first bearing section and against which the at least one control shaft abuts with a second circumferential section, which is located opposite the first circumferential section;

each of the first bearing part and the second bearing part has a respective inner surface, the inner surface of the first bearing part facing the inner surface of the second bearing part with respect to the transverse direction, and at least one flat positioning surface, which extends perpendicular to the transverse direction; and the at least one flat positioning surface of the first bearing part abuts flat against the at least one flat positioning surface of the second bearing part.

13. The intake module according to claim 12, wherein:

the first bearing part has, on the inner surface thereof, at least one guide pin, which projects in the transverse direction; and the second bearing part has, on the inner surface thereof, at least one guide opening, which is oriented in the transverse direction and which is complementary to the at least one guide pin, and into which the at least one guide pin is inserted in the transverse direction.

14. The intake module according to claim 1, wherein the housing has at least one inlet opening for fresh air and a flange section, which has the plurality of openings, which form outlet openings for fresh air.

15. The intake module according to claim 14, wherein the at least one bearing receiving portion is embodied on a connection side of the flange section, which is provided for a connection of the housing to the internal combustion engine.

16. The intake module according to claim 14, wherein:

the flange section has on a connection side thereof at least one sealing groove for receiving a seal, which abuts against the internal combustion engine so as to form a seal when the housing is connected to the internal combustion engine;

the at least one bearing receiving portion is arranged in a section of the at least one sealing groove, so that the at least one sealing groove has a groove break in an area of the at least one bearing receiving portion; and the at least one bearing bracket has, in an area of the at least one sealing groove, a groove section, which completes the at least one sealing groove in an area of the groove break.

17. The intake module according to claim 16, wherein at least one positioning block has a holding surface, which faces away from the at least one control shaft and which adjoins a groove base of the groove section in a flush manner.

18. An intake module of a fresh air system for an internal combustion engine, comprising:

a housing having a plurality of openings through which fresh air is flowable;

a control device for controlling a cross section, through which flow can pass, of at least one of the openings;

wherein the control device has at least one control shaft and at least one control valve, which is arranged on the at least one control shaft in a rotationally fixed manner, for the at least one opening;

wherein the at least one control shaft is mounted on the housing by at least one bearing bracket such that the at least one control shaft is rotatable about a rotational axis;

wherein the housing has at least one bearing receiving portion for receiving the at least one bearing bracket;

wherein the at least one bearing receiving portion has an insertion opening;

wherein the at least one bearing bracket is inserted in an insertion direction, which is oriented perpendicular to the rotational axis, through the insertion opening into the at least one bearing receiving portion;

wherein the at least one bearing bracket has on an outside thereof two outer surfaces, which face away from one another with respect to a transverse direction, which runs perpendicular to the rotational axis and perpendicular to the insertion direction;

wherein, on each outer surface, the at least one bearing bracket has at least two positioning blocks projecting therefrom in the transverse direction and spaced apart from one another with a distance therebetween and aligned with one another in the insertion direction, the one of the at least two positioning blocks that leads in the insertion direction is smaller than the other of the at least two positioning blocks that trails in the insertion direction;

wherein the at least one bearing receiving portion has on an inside thereof a guide contour, which is complementary thereto, for each positioning block for aligning the at least one bearing bracket in a longitudinal direction, which runs parallel to the rotational axis, and in the transverse direction.

19. The intake module according to claim 18, wherein the one of the at least two positioning blocks is arranged between the at least one control shaft and the other of the at least two positioning blocks in the insertion direction.

20. An intake module of a fresh air system for an internal combustion engine, comprising:

a housing having a plurality of openings through which fresh air is flowable;

a control device for controlling a cross section, through which flow can pass, of at least one of the openings;

wherein the control device has at least one control shaft and at least one control valve, which is arranged on the at least one control shaft in a rotationally fixed manner, for the at least one opening;

wherein the at least one control shaft is mounted on the housing by at least one bearing bracket such that the at least one control shaft is rotatable about a rotational axis;

wherein the housing has at least one bearing receiving portion for receiving the at least one bearing bracket;

wherein the at least one bearing receiving portion has an insertion opening;

wherein the at least one bearing bracket is inserted in an insertion direction, which is oriented perpendicular to the rotational axis, through the insertion opening into the at least one bearing receiving portion;

wherein the at least one bearing bracket has on an outside thereof two outer surfaces, which face away from one another with respect to a transverse direction, which runs perpendicular to the rotational axis and perpendicular to the insertion direction;

wherein, on each outer surface, the at least one bearing bracket has at least two positioning blocks projecting therefrom and spaced apart from one another in the insertion direction;

wherein the at least one bearing receiving portion has on an inside thereof a guide contour, which is complementary thereto, for each positioning block for aligning the at least one bearing bracket in a longitudinal direction, which runs parallel to the rotational axis, and in the transverse direction;

wherein the housing has at least one inlet opening for fresh air and a flange section, which has the plurality of openings, which form outlet openings for fresh air;

wherein the flange section has on a connection side thereof at least one sealing groove for receiving a seal, which abuts against the internal combustion engine so as to form a seal when the housing is connected to the internal combustion engine;

wherein the at least one bearing receiving portion is arranged in a section of the at least one sealing groove, so that the at least one sealing groove has a groove break in an area of the at least one bearing receiving portion; and wherein the at least one bearing bracket has, in an area of the at least one sealing groove, a groove section, which completes the at least one sealing groove in an area of the groove break.

* * * * *